US011802687B2

(12) United States Patent
Chitgopekar et al.

(10) Patent No.: US 11,802,687 B2
(45) Date of Patent: Oct. 31, 2023

(54) METHOD OF EFFICIENCY ENHANCEMENT OF FIRED HEATERS WITHOUT AIR PREHEAT SYSTEMS

(71) Applicant: UOP LLC, Des Plaines, IL (US)

(72) Inventors: Nitin P. Chitgopekar, Hoffman Estates, IL (US); William Yanez, Crystal Lake, IL (US); Ka L. Lok, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 14 days.

(21) Appl. No.: 17/646,520

(22) Filed: Dec. 30, 2021

(65) Prior Publication Data

US 2022/0252254 A1 Aug. 11, 2022

Related U.S. Application Data

(60) Provisional application No. 63/146,604, filed on Feb. 6, 2021.

(51) Int. Cl.

| | |
|---|---|
| ***F24H 8/00*** | (2022.01) |
| ***F22B 1/18*** | (2006.01) |
| ***F22D 1/28*** | (2006.01) |
| ***F22D 1/12*** | (2006.01) |

(52) U.S. Cl.

CPC ..... *F22B 1/1884* (2013.01); *F22D 1/12* (2013.01); *F22D 1/28* (2013.01)

(58) Field of Classification Search

CPC . F22B 1/1884; F22D 1/12; F22D 1/28; F24H 8/00; F27B 7/2016

See application file for complete search history.

(56) References Cited

U.S. PATENT DOCUMENTS

| | | | | |
|---|---|---|---|---|
| 4,483,766 | A * | 11/1984 | James. Jr. | B01J 8/12 208/101 |
| 4,489,679 | A * | 12/1984 | Holt | F22D 1/12 236/14 |
| 9,310,288 | B2 | 4/2016 | Sharpe, Jr. et al. | |
| 9,725,778 | B2 * | 8/2017 | Martinis | F27D 25/00 |
| 10,190,060 | B2 * | 1/2019 | Van Willigenburg | C10G 9/002 |
| 2013/0274531 | A1 | 10/2013 | Glomb et al. | |
| 2017/0022429 | A1 | 1/2017 | Van Willigenburg | |

FOREIGN PATENT DOCUMENTS

| | | | | |
|---|---|---|---|---|
| EP | 1059486 | B1 * | 7/2006 | F22B 1/1838 |
| EP | 2653524 | A1 | 10/2013 | |
| RU | 2764677 | C2 * | 1/2022 | C10G 9/002 |

(Continued)

OTHER PUBLICATIONS

International Search Report from corresponding PCT application No. PCT/US2022/070452 dated May 5, 2022.

(Continued)

*Primary Examiner* — Gregory A Wilson

(57) ABSTRACT

A method for improving the efficiency of a fired heater without an air preheat system is described. The method involves the use of an additional outboard convection section which is separate from the regular convection section of the fired heater. The outboard convection section uses the boiler feed water or an alternate cold sink to reduce the temperature of the flue gas, thereby improving the efficiency.

20 Claims, 1 Drawing Sheet

(56) References Cited

FOREIGN PATENT DOCUMENTS

| | | | |
|---|---|---|---|
| WO | 2010117614 | A2 | 10/2010 |
| WO | 2018183537 | A1 | 10/2018 |
| WO | 2018229267 | A1 | 12/2018 |
| WO | WO-2022155434 | A1 * | 7/2022 |

OTHER PUBLICATIONS

Written Opinion from corresponding PCT application No. PCT/US2022/070452 dated May 5, 2022.

* cited by examiner

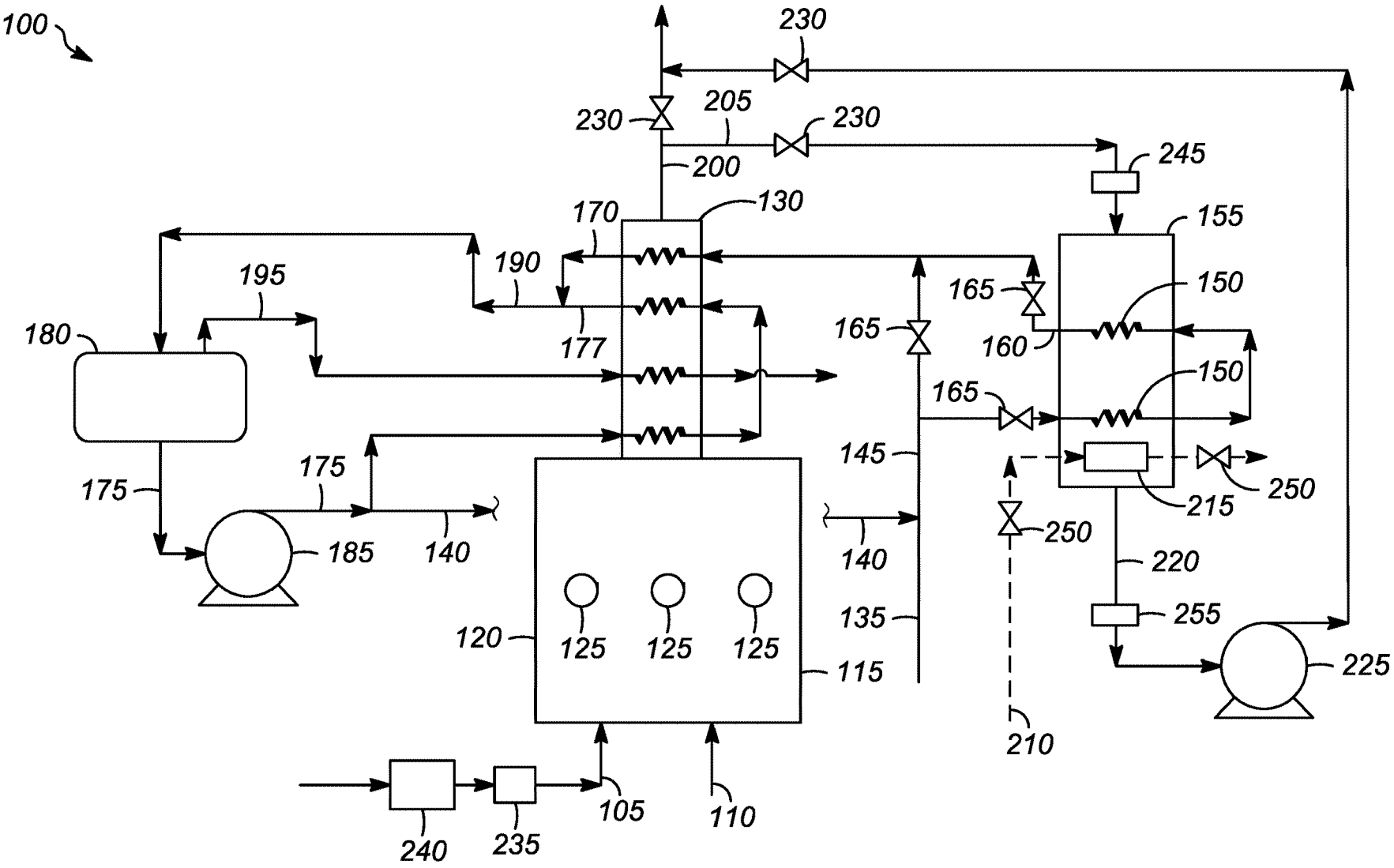
100
105
110
115
120
125
125
125
130
135
140
140
145
150
150
155
160
165
165
165
170
175
175
177
180
185
190
195
200
205
210
215
220
225
230
230
230
235
240
245
250
250
255

METHOD OF EFFICIENCY ENHANCEMENT OF FIRED HEATERS WITHOUT AIR PREHEAT SYSTEMS

RELATED APPLICATIONS

This application claims priority to U.S. Provisional Patent Application Ser. No. 63/146,604 filed on Feb. 6, 2021, the entirety of which is incorporated herein by reference.

BACKGROUND

Some catalytic reforming process units and catalytic dehydrogenation process units use fired heaters with end wall firing burners and multi-pass U-shaped coils in the radiant section of these heaters (with radiant coil inlet and outlet manifolds above the radiant section) in the reactor section of these process units. Implementing air preheat systems (APH) on these heaters is extremely difficult, if not virtually impossible, for multiple reasons related to the combustion air ducting arrangement. First, the lack of space for combustion air flow metering using venturis for multiple, independent services in these heaters means lead/lag control of the air to fuel ratio cannot be implemented which affects safety. The air sub-ducts to the individual burners end up with sharp turns (often multiple in series) in the immediate vicinity of the burners, negatively affecting the flame patterns of the burners. In addition, the air ducts obstruct access to the end wall observation openings which are critical for on-line monitoring of the heaters. Finally, the poor aspect ratio of ducts contravenes good engineering practice and may result in unequal air distribution to the burners.

Without APH systems, the efficiency of these heaters is determined by the flue gas temperature exiting the convection section. In these heaters, the entire convection section is mounted on top of the radiant section, with the convection section in waste heat recovery service typically comprising steam generation, a steam superheater if required, and boiler feed water (BFW) economizer coils. Any attempt to improve efficiency by reducing the flue gas convection exit temperature risks flue gas acid dew point attack on the heat transfer tubes (typically the economizer tubes) at the cold end of the convection section. The attack is a corrosion mechanism due to flue gas acidic constituents from sulfur in the fuel being fired in the radiant section, which can lead to failure of the tubes resulting in heater shutdown and loss of production.

To prevent this acid dew point attack, the surface temperature of the outside diameter (OD) of the convection section cold end heat transfer tube in contact with the flue gas needs to be high enough above the acid dew point temperature to avoid condensation. Keeping the surface temperatures of the cold end tube OD in the desired region means that the temperature of the BFW from battery limits needs to be increased by an external means before it enters the economizer coil. This is typically accomplished by the addition of a slip stream of circulating water from the steam drum. The BFW temperature increase, in turn, drives the flue gas convection exit bulk temperature higher due to the requirement of a driving force for the heat transfer, leading to lower efficiency.

Higher efficiency fired heaters are increasingly required due to local and national government mandates around the world.

Therefore, there is a need for a method of increasing the efficiency of fired heaters without using APH systems.

BRIEF DESCRIPTION OF THE DRAWING

The FIGURE is an illustration of one embodiment of the present invention.

DESCRIPTION OF THE INVENTION

The present process provides improved fuel efficiencies at a substantial capital cost advantage over APH systems.

The method provides greater than 90-92% efficiency typically achieved in current designs. Improved efficiencies of up to 95% may be achieved depending on the cold sink temperature availability. The efficiency improved from 92.2% in a process without the outboard convection section to 93.2% when it was incorporated. The improved efficiency comes without compromising on heater safety due to poor air ducting arrangements for heaters with APH systems. In addition, it is less expensive compared to APH systems because of the elimination of forced draft fans, air ducting and metering, and costly flue gas/air preheaters in the APH system. The process also provides higher convection total absorbed duty and more steam export.

The process can be incorporated into processes using end wall fired heaters, such as catalytic reforming processes and catalytic dehydrogenation processes. It could also be used in lieu of APH systems with other types of heaters, including vertically upwards fired from the radiant floor, to reduce capital costs, provided an appropriate cold sink is available for the outboard convection section coil(s).

In one aspect, an additional partial outboard convection section (i.e., outside the regular convection section on top of the radiant section) is used with a BFW preheat coil that is upstream of the BFW economizer coil in the main convection section. It uses the lower temperature BFW at its inlet (a colder sink) to reduce flue gas temperatures further, thereby improving efficiency.

Although it is more susceptible to corrosion, the outboard coil(s) is much easier to monitor for corrosion compared to coils located in the main convection section. It is also easier to replace because of bypasses provided around the outboard coil on both the coil side (inside the tubes) and the flue gas side (outside the coils). This allows the main heater to continue to operate without the main heater being required to be shut down when replacing the outboard coils. Flue gas bypass around the main fired heater convection coil is extremely difficult, requiring heater shutdown to replace any coils therein.

In some configurations, flue gas from the fired heater convection section flows vertically downwards through this outboard convection coil(s) so that the coldest tube OD surface temperature is at the bottom. As a result, any acid condensation is swept away, instead of dripping on other tube rows as would occur when the flue gas flows vertically upwards through the main convection section.

The flue gas leaving the convection section of the fired heater flows through an additional, external outboard convection section. Lower temperature BFW from battery limits enters the outboard convection section coil. The BFW exiting from the outboard convection section coil is routed to the BFW economizer coil in the fired heater convection section. This arrangement integrates the outboard convection section coil with the main fired heater convection section steam system service.

Alternatively, an independent, separate cold sink comprising a suitable low temperature process or utility stream to be heated may be utilized in the outboard convection section coil to achieve improved efficiency instead of, or in addition to, the BFW preheat coil. In this case, the exit from the outboard convection section coil with the independent cold sink will not flow to the fired heater convection section.

An induced draft fan may optionally be provided downstream of the outboard coil to aid flue gas hydraulics in some configurations.

A bypass may be provided on the in-tube side of the outboard convection section coil if it is integrated with the fired heater convection section. Isolation valves at the coil inlet and outlet may be provided for the independent outboard convection coil(s). A bypass may also be provided on the flue gas side. The flue gas side bypass is designed to encompass the outboard convection section or both the outboard convection section and the optional induced draft fan.

The outboard convection section coil(s) may be fabricated from a material that is resistant to acid dew point attack (e.g., Corten steel), or from materials such as carbon steel which is commonly used in the fired heater convection economizer coil. Other materials like Teflon or enamel coated carbon steel tubes may also be used.

The flue gas is discharged to atmosphere via a stack that may be mounted on top of the fired heater convection section or at grade.

As discussed above, the process can be used to improve the efficiency of end wall fired heaters, such as catalytic reforming processes and catalytic dehydrogenation processes (as well as others). The reactor section process stream is heated primarily in the radiant section of the fired heaters with additional waste heat recovery occurring in the convection section using a steam system (e.g., economizer, steam generation and superheater, if needed).

The efficiency of these heaters is dictated by the flue gas convection section exit temperatures: the colder the flue gas, the higher the waste heat recovery and overall heater fuel efficiency. The flue gas convection exit section temperature is set by: (a) approach to the flue gas acid dew point temperature of the bulk gas (the bulk temperature has some margin above the acid dew point temperature); (b) minimum metal temperature of the heat transfer tubes in contact with the flue gas being above the acid dew point temperature (some margin needed, typically about 14° C. (25° F.), to prevent attack); and (c) the cold end approach temperature which equals the flue gas bulk exit temperature minus the cold process bulk temperature at coil inlet to drive heat transfer (typically about 25-30° C. minimum).

For a typical flue gas acid dew point temperature of 110° C. (which depends on the total sulfur content of the fuel gas being fired), the flue gas convection section exit temperature of 150° C. can be achieved with an economizer coil inlet temperature of 124° C., resulting in a fuel efficiency of approximately 92% with 15% excess air.

The BFW is often available at a colder temperature at battery limits than is required by the typical scheme described above, but it cannot be used as is to prevent acid dew point attack on heat transfer tubes. This limits waste heat recovery from flue gas due to the cold end approach temperature requirements for driving heat transfer, forcing higher flue gas convection section exit temperatures and lower efficiency. Generally, a maximum flue gas acid dew point temperature is determined a priori during design based on considering the range of fuel gas compositions to be fired and their total sulfur content, and the incoming BFW temperature is raised to a fixed economizer coil inlet temperature to achieve necessary temperature margin above the maximum acid dew point temperature.

The process can include analyzing the fuel gas sulfur content on-line and determining flue gas acid dew point externally and/or measuring flue gas acid dew point directly using sensors. The combination is preferred for maximum certainty, although not required. The outboard economizer coil bulk inlet temperature can then be set to a minimum value based on the desired margin (which may even be zero or negative depending on risk tolerance of operator) above the acid dew point temperature, instead of always increasing the economizer coil inlet temperature to a fixed high value considering maximum flue gas acid dew point temperature as is done currently. The temperature adjustment of the economizer coil inlet temperature is achieved by mixing a slip stream of the circulating water from the steam drum (at a much higher temperature of steam drum) being circulated through the steam generation coils with the incoming, cold BFW from battery limits. The flowrate of the slip stream is varied based on the acid dew point temperature (whether directly measured and/or inferred from the fuel sulfur analysis) and a variable acceptable margin (which may even be zero or negative depending on the risk tolerance of the operator to the dew point attack of the heat transfer tubes) above the acid dew point temperature. This results in the flue gas exit temperature being minimized at all times, leading to maximum heat recovery from the flue gas and continued highest fuel efficiency operation.

The use of the outboard convection section coil(s) allows for close monitoring of any potential dew point attack on heat transfer surfaces in the coil(s). The outboard convection section coil(s) can be easily replaced without having to shut down main heater, and consequently the unit, since there are bypasses provided around the BFW preheat coil, the isolation valves at inlet and outlet of coils with independent cold sink stream, and the flue gas side in some configurations. This is not possible when the proposed outboard convection section coil(s) is located in the fired heater convection section. If the outboard convection section coil is arranged for flow of the flue gas vertically downward and the inside coil stream flowing counter-current to the flue gas to maximize heat recovery, then the minimum metal temperature will occur in the lowest row(s) of the outboard convection section coil. Any acid condensation will be swept out with the flue gas, unlike when the flue gas is flowing vertically upwards through the main convection section and the minimum metal temperature occurs in the topmost row, and the condensation drips down to additional rows below.

In some configurations, a local fuel gas sulfur removal unit may be used upstream of the fired heaters to minimize sulfur in the fuel gas. This minimizes the acid dew point temperature, and consequently allows lowering the flue gas exit temperature further to achieve maximum efficiency. The sulfur removal may be down to untraceable levels if desired. Any suitable sulfur removal process can be used. Suitable sulfur removal processes include, but are not limited to, amine absorption processes, guard beds and membrane separation.

In some configurations, the flue gas may be treated to substantially remove oxides of sulfur from the flue gas, minimizing further or eliminating entirely the constraint posed by the acid dew point temperature because there are no precursors for acid formation in the flue gas. As a result, additional heat can be recovered from the flue gas using a much colder sink, potentially reaching the water dew point temperature of the water content in the flue gas in a condensing exchanger thereby recovering latent heat from the flue gas (with its water content being condensed) instead of just sensible heat. The cold sink may be BFW if it has adequately low entering temperature. Alternately, another cold sink with low available temperature may be used in an additional coil located downstream (in the direction of flue gas flow) of the BFW coil in the outboard convection section. The flue gas treatment block may be located at any suitable location upstream of the outboard convection section coil(s). Any suitable sulfur oxide removal process can be used. Suitable sulfur oxide removal processes include, but are not limited to once-through and regenerable flue gas desulfurization with both being classified further into wet and dry technologies.

One aspect of the invention is a method for improving the efficiency of a fired heater. In one embodiment, the method comprises: providing the fired heater comprising a radiant section and a fired heater convection section mounted on the radiant section, the radiant section comprising at least one burner; combusting fuel gas and an oxygen-containing gas in the at least one burner of the radiant section forming flue gas, the flue gas flowing from the radiant section to the fired heater convection section; passing a boiler feed water stream through the fired heater convection section to increase a temperature of the boiler feed water stream and form a heated boiler feed water stream, wherein optionally a portion of the heated boiler feed water stream comprises steam; passing a circulating water stream from a steam drum through the fired heater convection section to add heat to the circulating water stream and form a mixture of water and steam; combining the heated boiler feed water stream and the heated circulating water stream into a combined stream; separating the combined stream in the steam drum into a steam stream and the circulating water stream; passing a least a portion of the flue gas from the fired heater convection section to an outboard convection section spaced apart from the fired heater convection section, or optionally bypassing the step of passing the least the portion of the flue gas from the fired heater convection section to the outboard convection section; and releasing the flue gas to atmosphere.

In some embodiments, passing the least the portion of the flue gas from the fired heater convection section to the outboard convection section comprises: passing the boiler feed water stream through the outboard convection section to cool the flue gas and increase a temperature of the boiler feed water stream before passing the boiler feed water stream through the fired heater convection section, or optionally bypassing the step of passing the boiler feed water stream through the outboard convection section; and wherein releasing the flue gas to the atmosphere comprises releasing the cooled flue gas to the atmosphere.

In some embodiments, the method further comprises: providing a tube side bypass valve to selectively bypass the step of passing the boiler feed water stream through the outboard convection section.

In some embodiments, passing the least the portion of the flue gas from the fired heater convection section to the outboard convection section comprises: passing a separate stream through a coil in the outboard convection section to cool the flue gas and increase a temperature of the separate stream.

In some embodiments, the method further comprises: providing isolation valves at an inlet and an outlet of the coil to isolate it from the separate stream.

In some embodiments, passing the least the portion of the flue gas from the fired heater convection section to the outboard convection section to cool the flue gas comprises: passing the least the portion of the flue gas from the fired heater convection section vertically downward through the outboard convection section to cool the flue gas.

In some embodiments, the method further comprises: passing the flue gas from the outboard convection section through an induced draft fan before releasing the cooled gas to the atmosphere.

In some embodiments, the method further comprises: providing a flue gas bypass valve to selectively bypass passing the least the portion of the flue gas from the fired heater convection section to the outboard convection section.

In some embodiments, the method further comprises: passing the steam stream through the fired heater convection section to increase a temperature of the steam stream.

In some embodiments, the efficiency of the fired heater is greater than 93%.

In some embodiments, the method further comprises: measuring a sulfur content of the fuel gas; determining a flue gas acid dew point from the sulfur content; and adjusting a temperature of the boiler feed water stream entering the fired heater convection section based on the flue gas acid dew point and a desired temperature margin using a slip stream of the circulating water stream from the steam drum.

In some embodiments, the method further comprises: measuring a flue gas acid dew point; and adjusting a temperature of the boiler feed water stream entering the fired heater convection section based on the flue gas acid dew point and a desired temperature margin using a slip stream of the circulating water stream from the steam drum.

In some embodiments, the method further comprises: removing sulfur from the fuel gas before combusting the fuel gas in the at least one burner.

In some embodiments, the method further comprises: removing sulfur oxides from the least the portion of the flue gas before passing the least the portion of the flue gas from the fired heater convection section to the outboard convection section.

Another aspect of the invention is a method for improving the efficiency of a fired heater. In one embodiment, the method comprises: providing the fired heater comprising a radiant section and a fired heater convection section mounted on the radiant section, the radiant section comprising at least one burner; combusting fuel gas and an oxygen-containing gas in the at least one burner of the radiant section forming flue gas, the flue gas flowing from the radiant section to the fired heater convection section; passing a boiler feed water stream through the fired heater convection section to increase a temperature of the boiler feed water stream and form a heated boiler feed water stream, wherein optionally a portion of the heated boiler feed water stream comprises steam; passing a circulating water stream from a steam drum through the fired heater convection section to add heat to the circulating water stream and form a mixture of water and steam; combining the heated boiler feed water stream and the heated circulating water stream into a combined stream; separating the combined stream in the steam drum into a steam stream and the circulating water stream; passing a least a portion of the flue gas from the fired heater convection section vertically downward through an outboard convection section spaced apart from the fired heater convection section, or optionally bypassing the step of passing the least the portion of the flue gas from the fired heater convection section to the outboard convection section; passing the boiler feed water stream through the outboard convection section before passing the boiler feed water stream through the fired heater convection section to cool the flue gas and increase a temperature of the boiler feed water stream, or optionally bypassing the step of passing the boiler feed water stream through the outboard convection section; and releasing the cooled flue gas to atmosphere.

In some embodiments, the method further comprises at least one of: providing a tube side bypass valve to selectively bypass the step of passing the boiler feed water stream through the outboard convection section; and providing a flue gas bypass valve to selectively bypass passing the least the portion of the flue gas from the fired heater convection section to the outboard convection section.

In some embodiments, the method further comprises: passing the cooled flue gas through an induced draft fan before releasing the cooled gas to the atmosphere.

In some embodiments, the method further comprises: passing the steam stream through the fired heater convection section to increase a temperature of the steam stream.

In some embodiments, the method further comprises at least one of: measuring a sulfur content of the fuel gas; determining a flue gas acid dew point from the sulfur content; and adjusting a temperature of the boiler feed water stream entering the fired heater convection section based on the flue gas acid dew point and a desired temperature margin using a slip stream of circulating water from the steam drum; and measuring a flue gas acid dew point; and adjusting a temperature of the boiler feed water stream entering the fired heater convection section based on the flue gas acid dew point and a desired temperature margin using a slip stream of circulating water from the steam drum.

In some embodiments, the method further comprises at least one of: removing sulfur from the fuel gas before combusting the fuel gas in the at least one burner; and removing sulfur oxides from the least the portion of the flue gas before passing the least the portion of the flue gas from the fired heater convection section to the outboard convection section.

The FIGURE illustrates one embodiment of the process 100. Fuel gas stream 105 and combustion air stream 110 are introduced into the radiant section 115 of a fired heater 120. The fuel gas and combustion air are combusted in burners 125 in the radiant section 115. Flue gas from the radiant section 115 flows into the convection section 130 of the fired heater 120.

BFW stream 135 is sent to an outboard convection section 155 where it is pre-heated. A slip stream 140 can be mixed with the BFW stream 135 to form a mixed BFW stream 145 to achieve the desired temperature of the mixed steam at the inlet of the outboard convection BFW preheat coil 150 of the outboard convection section 155. The temperature of the mixed BFW stream 145 is increased as it passes through the outboard convection BFW preheat coil 150. The pre-heated BFW stream 160 exits the outboard convection section 155 and is sent to the fired heater convection section 130.

There is a tube side bypass valve(s) 165 which allows the mixed BFW stream 145 to bypass the outboard convection section 155 and to be sent to the fired heater convection section 130 without passing through the outboard convection section 155.

The pre-heated BFW stream 160 or the mixed BFW stream 145 passes through the fired heater convection section 130 to form a heated BFW stream 170. In some embodiments, a portion of the heated BFW stream 170 comprises steam.

A circulating water stream 175 from a steam drum 180 and pumped by circulating water pump 185 is passed through the fired heater convection section 130, which increases the temperature of the circulating water stream 175 and forms a mixture of water and steam as heated circulating water stream 177. A slip stream 140 of the circulating water stream 175 can be mixed with the BFW stream 135 as discussed above.

The heated BFW stream 170 is combined with heated circulating water stream 177 to form a combined stream 190. The combined stream 190 is sent to the steam drum 180 where it is separated into the circulating water stream 175 and steam stream 195.

Steam stream 195 can be sent through the fired heater convection section 130 to increase the temperature of the steam.

The flue gas stream 200 exits the fired heater convection section 130 and at least a portion 205 is sent to the outboard convection section 155. The outboard convection section 155 is separate from and spaced apart from the fired heater convection section 130. The portion 205 of the flue gas stream 200 passes through the outboard convection section 155 where it is cooled by the mixed BFW stream 145. The portion 205 can be any amount greater than 0 up to 100% of the flue gas stream 200. Typically, the entire flue gas stream 200 is sent as portion 205 to the outboard convection section 155.

Alternatively, instead of, or in addition to, using the mixed BFW stream 145 to cool the portion 205 of the flue gas stream 200, a separate stream 210 could be passed through a coil 215 in the outboard convection section 155 to cool the portion 205 of the flue gas stream 200. This coil 215 may be a condensing exchanger for recovering latent heat from the flue gas, or it may simply reduce the flue gas temperature further to increase efficiency. There are tube side isolation valves 250 at the inlet and outlet of coil 215.

The cooled flue gas stream 220 can be sent through a fan 225, such as an induced draft fan, before being returned to the stack and released to the atmosphere.

There can be a flue gas bypass valve(s) 230 which can allow the flue gas stream 200 to bypass the outboard convection section 155 and exit the stack to the atmosphere.

Optionally, the sulfur content of the fuel gas can be measured using an analyzer 235, if desired.

The fuel gas stream 105 can optionally be sent to a local fuel gas sulfur removal unit 240 before being sent to the fired heater 120 to remove sulfur from the fuel gas stream 105.

There can optionally be a sulfur oxide removal unit 245 to remove sulfur oxides from the flue gas stream 200 in some processes. It can be located at any appropriate location prior to the outboard convection section 155.

There can optionally be an acid dew point sensor 255 at the exit of the outboard convection section 155.

SPECIFIC EMBODIMENTS

While the following is described in conjunction with specific embodiments, it will be understood that this description is intended to illustrate and not limit the scope of the preceding description and the appended claims.

A first embodiment of the invention is a method for improving the efficiency of a fired heater comprising providing the fired heater comprising a radiant section and a fired heater convection section mounted on the radiant section, the radiant section comprising at least one burner; combusting fuel gas and an oxygen-containing gas in the at least one burner of the radiant section forming flue gas, the flue gas flowing from the radiant section to the fired heater convection section; passing a boiler feed water stream through the fired heater convection section to increase a temperature of the boiler feed water stream and form a heated boiler feed water stream, wherein optionally a portion of the heated boiler feed water stream comprises steam; passing a circulating water stream from a steam drum through the fired heater convection section to add heat to the circulating water stream and form a mixture of water and steam; combining the heated boiler feed water stream and the heated circulating water stream into a combined stream; separating the combined stream in the steam drum into a steam stream and the circulating water stream; passing at least a portion of the flue gas from the fired heater convection section to an outboard convection section spaced apart from the fired heater convection section, or optionally bypassing the step of passing the at least the portion of the flue gas from the fired heater convection section to the outboard convection section; and releasing the flue gas to atmosphere. An embodiment of the invention is one, any or all of prior embodiments in this paragraph up through the first embodiment in this paragraph wherein passing the at least the portion of the flue gas from the fired heater convection section to the outboard convection section comprises passing the boiler feed water stream through the outboard convection section to cool the flue gas and increase a temperature of the boiler feed water stream before passing the boiler feed water stream through the fired heater convection section, or optionally bypassing the step of passing the boiler feed water stream through the outboard convection section; and wherein releasing the flue gas to the atmosphere comprises releasing the cooled flue gas to the atmosphere. An embodiment of the invention is one, any or all of prior embodiments in this paragraph up through the first embodiment in this paragraph further comprising providing a tube side bypass valve to selectively bypass the step of passing the boiler feed water stream through the outboard convection section. An embodiment of the invention is one, any or all of prior embodiments in this paragraph up through the first embodiment in this paragraph wherein passing the at least the portion of the flue gas from the fired heater convection section to the outboard convection section comprises passing a separate stream through a coil in the outboard convection section to cool the flue gas and increase a temperature of the separate stream. An embodiment of the invention is one, any or all of prior embodiments in this paragraph up through the first embodiment in this paragraph further comprising providing isolation valves at an inlet and an outlet of the coil to isolate it from the separate stream. An embodiment of the invention is one, any or all of prior embodiments in this paragraph up through the first embodiment in this paragraph wherein passing the at least the portion of the flue gas from the fired heater convection section to the outboard convection section to cool the flue gas comprises passing the at least the portion of the flue gas from the fired heater convection section vertically downward through the outboard convection section to cool the flue gas. An embodiment of the invention is one, any or all of prior embodiments in this paragraph up through the first embodiment in this paragraph further comprising passing the flue gas from the outboard convection section through an induced draft fan before releasing the flue gas to the atmosphere. An embodiment of the invention is one, any or all of prior embodiments in this paragraph up through the first embodiment in this paragraph further comprising providing a flue gas bypass valve to selectively bypass passing the at least the portion of the flue gas from the fired heater convection section to the outboard convection section. An embodiment of the invention is one, any or all of prior embodiments in this paragraph up through the first embodiment in this paragraph further comprising passing the steam stream through the fired heater convection section to increase a temperature of the steam stream. An embodiment of the invention is one, any or all of prior embodiments in this paragraph up through the first embodiment in this paragraph wherein the efficiency of the fired heater is greater than 93%. An embodiment of the invention is one, any or all of prior embodiments in this paragraph up through the first embodiment in this paragraph further comprising measuring a sulfur content of the fuel gas; determining a flue gas acid dew point from the sulfur content; and adjusting a temperature of the boiler feed water stream entering the fired heater convection section based on the flue gas acid dew point and a desired temperature margin using a slip stream of the circulating water stream from the steam drum. An embodiment of the invention is one, any or all of prior embodiments in this paragraph up through the first embodiment in this paragraph further comprising measuring a flue gas acid dew point; and adjusting a temperature of the boiler feed water stream entering the fired heater convection section based on the flue gas acid dew point and a desired temperature margin using a slip stream of the circulating water stream from the steam drum. An embodiment of the invention is one, any or all of prior embodiments in this paragraph up through the first embodiment in this paragraph further comprising removing sulfur from the fuel gas before combusting the fuel gas in the at least one burner. An embodiment of the invention is one, any or all of prior embodiments in this paragraph up through the first embodiment in this paragraph further comprising removing sulfur oxides from the least the portion of the flue gas before passing the at least the portion of the flue gas from the fired heater convection section to the outboard convection section.

A second embodiment of the invention is a method for improving the efficiency of a fired heater comprising providing the fired heater comprising a radiant section and a fired heater convection section mounted on the radiant section, the radiant section comprising at least one burner; combusting fuel gas and an oxygen-containing gas in the at least one burner of the radiant section forming flue gas, the flue gas flowing from the radiant section to the fired heater convection section; passing a boiler feed water stream through the fired heater convection section to increase a temperature of the boiler feed water stream and form a heated boiler feed water stream, wherein optionally a portion of the heated boiler feed water stream comprises steam; passing a circulating water stream from a steam drum through the fired heater convection section to add heat to the circulating water stream and form a mixture of water and steam; combining the heated boiler feed water stream and the heated circulating water stream into a combined stream; separating the combined stream in the steam drum into a steam stream and the circulating water stream; passing at least a portion of the flue gas from the fired heater convection section vertically downward through an outboard convection section spaced apart from the fired heater convection section, or optionally bypassing the step of passing the at least the portion of the flue gas from the fired heater convection section to the outboard convection section; passing the boiler feed water stream through the outboard convection section before passing the boiler feed water stream through the fired heater convection section to cool the flue gas and increase a temperature of the boiler feed water stream, or optionally bypassing the step of passing the boiler feed water stream through the outboard convection section; and releasing the cooled flue gas to atmosphere. An embodiment of the invention is one, any or all of prior embodiments in this paragraph up through the second embodiment in this paragraph further comprising at least one of providing a tube side bypass valve to selectively bypass the step of passing the boiler feed water stream through the outboard convection section; and providing a flue gas bypass valve to selectively bypass passing the at least the portion of the flue gas from the fired heater convection section to the outboard convection section. An embodiment of the invention is one, any or all of prior embodiments in this paragraph up through the second embodiment in this paragraph further comprising passing the cooled flue gas through an induced draft fan before releasing the cooled gas to the atmosphere. An embodiment of the invention is one, any or all of prior embodiments in this paragraph up through the second embodiment in this paragraph further comprising passing the steam stream through the fired heater convection section to increase a temperature of the steam stream. An embodiment of the invention is one, any or all of prior embodiments in this paragraph up through the second embodiment in this paragraph further comprising at least one of measuring a sulfur content of the fuel gas; determining a flue gas acid dew point from the sulfur content; and adjusting a temperature of the boiler feed water stream entering the fired heater convection section based on the flue gas acid dew point and a desired temperature margin using a slip stream of circulating water from the steam drum; and measuring a flue gas acid dew point; and adjusting a temperature of the boiler feed water stream entering the fired heater convection section based on the flue gas acid dew point and a desired temperature margin using a slip stream of circulating water from the steam drum. An embodiment of the invention is one, any or all of prior embodiments in this paragraph up through the second embodiment in this paragraph further comprising at least one of removing sulfur from the fuel gas before combusting the fuel gas in the at least one burner; removing sulfur oxides from the least the portion of the flue gas before passing the at least the portion of the flue gas from the fired heater convection section to the outboard convection section.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A method for improving the efficiency of a fired heater comprising:

providing the fired heater comprising a radiant section and a fired heater convection section mounted on the radiant section, the radiant section comprising at least one burner;

combusting fuel gas and an oxygen-containing gas in the at least one burner of the radiant section forming flue gas, the flue gas flowing from the radiant section to the fired heater convection section;

passing a boiler feed water stream through the fired heater convection section to increase a temperature of the boiler feed water stream and form a heated boiler feed water stream, wherein optionally a portion of the heated boiler feed water stream comprises steam;

passing a circulating water stream from a steam drum through the fired heater convection section to add heat to the circulating water stream and form a mixture of water and steam;

combining the heated boiler feed water stream and the heated circulating water stream into a combined stream;

separating the combined stream in the steam drum into a steam stream and the circulating water stream;

passing at least a portion of the flue gas from the fired heater convection section to an outboard convection section spaced apart from the fired heater convection section, or optionally bypassing the step of passing the at least the portion of the flue gas from the fired heater convection section to the outboard convection section; and releasing the flue gas to atmosphere.

2. The method of claim 1 wherein passing the at least the portion of the flue gas from the fired heater convection section to the outboard convection section comprises:

passing the boiler feed water stream through the outboard convection section to cool the flue gas and increase a temperature of the boiler feed water stream before passing the boiler feed water stream through the fired heater convection section, or optionally bypassing the step of passing the boiler feed water stream through the outboard convection section; and wherein releasing the flue gas to the atmosphere comprises releasing the cooled flue gas to the atmosphere.

3. The method of claim 2 further comprising:

providing a tube side bypass valve to selectively bypass the step of passing the boiler feed water stream through the outboard convection section.

4. The method of claim 1 wherein passing the at least the portion of the flue gas from the fired heater convection section to the outboard convection section comprises:

passing a separate stream through a coil in the outboard convection section to cool the flue gas and increase a temperature of the separate stream.

5. The method of claim 4 further comprising:

providing isolation valves at an inlet and an outlet of the coil to isolate it from the separate stream.

6. The method of claim 1 wherein passing the at least the portion of the flue gas from the fired heater convection section to the outboard convection section to cool the flue gas comprises:

passing the at least the portion of the flue gas from the fired heater convection section vertically downward through the outboard convection section to cool the flue gas.

7. The method of claim 1 further comprising:

passing the flue gas from the outboard convection section through an induced draft fan before releasing the cooled gas to the atmosphere.

8. The method of claim 1 further comprising:

providing a flue gas bypass valve to selectively bypass passing the at least the portion of the flue gas from the fired heater convection section to the outboard convection section.

9. The method of claim 1 further comprising:

passing the steam stream through the fired heater convection section to increase a temperature of the steam stream.

10. The method of claim 1 wherein the efficiency of the fired heater is greater than 93%.

11. The method of claim 1 further comprising:
measuring a sulfur content of the fuel gas;
determining a flue gas acid dew point from the sulfur content; and
adjusting a temperature of the boiler feed water stream entering the fired heater convection section based on the flue gas acid dew point and a desired temperature margin using a slip stream of the circulating water stream from the steam drum.

12. The method of claim 1 further comprising:
measuring a flue gas acid dew point; and
adjusting a temperature of the boiler feed water stream entering the fired heater convection section based on the flue gas acid dew point and a desired temperature margin using a slip stream of the circulating water stream from the steam drum.

13. The method of claim 1 further comprising:
removing sulfur from the fuel gas before combusting the fuel gas in the at least one burner.

14. The method of claim 1 further comprising:
removing sulfur oxides from the least the portion of the flue gas before passing the at least the portion of the flue gas from the fired heater convection section to the outboard convection section.

15. A method for improving the efficiency of a fired heater comprising:
providing the fired heater comprising a radiant section and a fired heater convection section mounted on the radiant section, the radiant section comprising at least one burner;
combusting fuel gas and an oxygen-containing gas in the at least one burner of the radiant section forming flue gas, the flue gas flowing from the radiant section to the fired heater convection section;
passing a boiler feed water stream through the fired heater convection section to increase a temperature of the boiler feed water stream and form a heated boiler feed water stream, wherein optionally a portion of the heated boiler feed water stream comprises steam;
passing a circulating water stream from a steam drum through the fired heater convection section to add heat to the circulating water stream and form a mixture of water and steam;
combining the heated boiler feed water stream and the heated circulating water stream into a combined stream;
separating the combined stream in the steam drum into a steam stream and the circulating water stream;
passing at least a portion of the flue gas from the fired heater convection section vertically downward through an outboard convection section spaced apart from the fired heater convection section, or optionally bypassing the step of passing the at least the portion of the flue gas from the fired heater convection section to the outboard convection section;
passing the boiler feed water stream through the outboard convection section before passing the boiler feed water stream through the fired heater convection section to cool the flue gas and increase a temperature of the boiler feed water stream, or optionally bypassing the step of passing the boiler feed water stream through the outboard convection section; and
releasing the cooled flue gas to atmosphere.

16. The method of claim 15 further comprising at least one of:
providing a tube side bypass valve to selectively bypass the step of passing the boiler feed water stream through the outboard convection section; and
providing a flue gas bypass valve to selectively bypass passing the at least the portion of the flue gas from the fired heater convection section to the outboard convection section.

17. The method of claim 15 further comprising:
passing the cooled flue gas through an induced draft fan before releasing the cooled gas to the atmosphere.

18. The method of claim 15 further comprising:
passing the steam stream through the fired heater convection section to increase a temperature of the steam stream.

19. The method of claim 15 further comprising at least one of:
measuring a sulfur content of the fuel gas;
determining a flue gas acid dew point from the sulfur content; and
adjusting a temperature of the boiler feed water stream entering the fired heater convection section based on the flue gas acid dew point and a desired temperature margin using a slip stream of circulating water from the steam drum;
and
measuring a flue gas acid dew point; and
adjusting a temperature of the boiler feed water stream entering the fired heater convection section based on the flue gas acid dew point and a desired temperature margin using a slip stream of circulating water from the steam drum.

20. The method of claim 15 further comprising at least one of:
removing sulfur from the fuel gas before combusting the fuel gas in the at least one burner; and
removing sulfur oxides from the least the portion of the flue gas before passing the at least the portion of the flue gas from the fired heater convection section to the outboard convection section.

* * * * *